United States Patent [19]

Tabuchi et al.

[11] 4,284,702

[45] Aug. 18, 1981

[54] ELECTROGRAPHIC DEVELOPING METHOD

[75] Inventors: Kenji Tabuchi; Susumu Tanaka; Kenichi Wada; Tateki Oka; Hiroaki Mizunoe, all of Sakai, Japan

[73] Assignee: Minolta Camera Kabushiki Kaisha, Osaka, Japan

[21] Appl. No.: 104,456

[22] Filed: Dec. 17, 1979

Related U.S. Application Data

[63] Continuation of Ser. No. 949,426, Oct. 5, 1978, abandoned.

[51] Int. Cl.[3] ..... G03G 13/08; G03G 13/09

[52] U.S. Cl. ..... 430/122; 430/107; 430/108; 118/657

[58] Field of Search ..... 430/107, 108, 122

[56] References Cited

U.S. PATENT DOCUMENTS

| | | | |
|---|---|---|---|
| 3,607,750 | 9/1971 | Raney et al. | 430/108 |
| 3,895,125 | 7/1975 | Tsuchiya et al. | 430/108 X |
| 3,906,121 | 9/1975 | Fraser et al. | 430/122 |
| 3,947,370 | 3/1976 | Miller | 430/108 X |
| 4,154,520 | 5/1979 | Nishikawa | 430/122 |
| 4,165,393 | 8/1979 | Suzuki et al. | 430/122 |

*Primary Examiner*—Roland E. Martin, Jr.

*Attorney, Agent, or Firm*—Wenderoth, Lind & Ponack

[57] ABSTRACT

An electrographic developing method comprising forming a magnetic brush of a developer composed of at least two components of insulating toner particles and insulating carrier granules, and brushing a surface bearing an electrostatic latent image with the brush to render the latent image visible, the carrier granules having the properties of (1) triboelectrifying the toner particles to a polarity suitable for developing the latent image by coming into frictional contact with the toner particles, (2) being magnetic, (3) having a resistivity of at least $10^{12}$ ohm-cm, and (4) being 5 to 40 μm in size.

13 Claims, 2 Drawing Figures

ELECTROGRAPHIC DEVELOPING METHOD

CROSS-REFERENCES TO RELATED APPLICATION

This is a continuation of application Ser. No. 949,426, filed on Oct. 5, 1978, now abandoned.

BACKGROUND OF THE INVENTION

This invention relates to an electrographic developing method, and more particularly to a method of developing electrostatic latent images to visible images with a magnetic brush formed of a developer.

Electrophotographic processes generally include the steps of uniformly charging a photosensitive member and projecting an optical image onto the charged surface of the photosensitive member to form on the photosensitive surface an electrostatic latent image corresponding to the optical image. The theory of latent image formation is well known; when exposed to the optical image, the photosensitive member becomes conductive where the light impinges thereon, permitting the surface charges given by the charging to dissipate or decay in the conductive areas.

The photosensitive surface bearing the resulting electrostatic latent image involves potential differences between the exposed areas (with little or no charges) and the unexposed areas (charge retaining areas). Due to the presence of such potential differences, the latent image on the photosensitive surface can be developed to a visible image with fine pigmented toner particles electrostatically so charged as to be attractable to the unexposed areas (or exposed areas for reversal development) when the toner is applied to the photosensitive surface.

Various methods of developing electrostatic latent images in this way have been proposed and introduced into use. Typical of such methods is so-called "magnetic brush development" in which the surface of the latent image-bearing member (e.g. the above-mentioned photosensitive member) is brushed with a magnetic brush formed of a developer. This developing method usually employs a two-component developer composed of a carrier of iron granules about 100 to about 200 μm in diameter and a pigmented toner about 10 μm in particle size. The carrier material and the toner material are so selected that when the two materials are mixed together, each material becomes triboelectrically charged to a polarity opposite to that of the other and that the particulate toner material usually has a polarity opposite to that of the electrostatic latent image when so charged. When developing, the developer containing the toner particles electrostatically clinging to the surfaces of the carrier granules is brought into brushing contact with the latent image-bearing surface, whereupon the toner particles alone are separated from the carrier granules by the combined action of mechanical and electrostatic forces and deposited on the latent image areas by the charges of the image, thus developing the latent image to a visible image.

Although the developing method described is very useful and has many advantages, the method still has the following problems. (1) Unless the toner particles and the carrier granules are maintained in a constant mixing ratio at all times, the developer fails to produce the desired effect with stability. Moreover difficulties are encountered in maintaining the constant mixing ratio because of the limited range of permissible ratios. (2) When the developer is used for a prolonged period of time, so-called spent toner, which is no longer useful for development, becomes fused to the surfaces of carrier granules, thus degrading the developer and consequently giving toner images of reduced quality. This necessitates periodic replacement of the developer which is cumbersome and uneconomical. (3) The developed images have a narrow latitude, are not free of fogging and have a low degree of resolution.

SUMMARY OF THE INVENTION

The main object of this invention is to provide a novel and very useful electrographic developing method.

Another object of this invention is to provide an electrographic developing method free of the various problems inherent in the conventional magnetic brush development.

Another object of this invention is to provide an electrographic developing method suitable for electrophotographic copying machines of the toner image transfer type.

Still another object of this invention is to provide an electrographic developing method permitting the use of developing apparatus of simple construction.

These and other objects of the present invention can be fulfilled by an electrographic developing method comprising forming a magnetic brush of a developer composed of at least two components of insulating toner particles and insulating carrier granules, and brushing a surface bearing an electrostatic latent image with the brush to render the latent image visible, the carrier granules having the properties of (1) triboelectrifying the toner particles to a polarity (a polarity opposite to that of the latent image in positive-to-positive development, or the same polarity as that of the latent image in negative-to-positive development) suitable for developing the latent image by coming into frictional contact with the toner particles, (2) being magnetic, (3) having a resistivity of at least $10^{12}$ ohm-cm, and (4) being 5 to 40 μm in size.

These and other objects, advantages and features of the invention will become apparent from the following description thereof when read in conjunction with the accompanying drawings which illustrate exemplary embodiments of the invention.

BRIEF DESCRIPTION OF THE DRAWINGS

In the following description, like parts are designated by like reference numbers throughout the several diagrams of the attached drawings.

DETAILED DESCRIPTION OF THE INVENTION

In an attempt to analyze causes of the foregoing various problems involved in the conventional magnetic brush development, we conducted experiments and found that some of the problems can be overcome with use of carrier granules of reduced size.

However difficulties are actually encountered in using carrier granules of reduced diameter as will be described in detail below with reference to Experiments 1 to 3.

Figure 1:
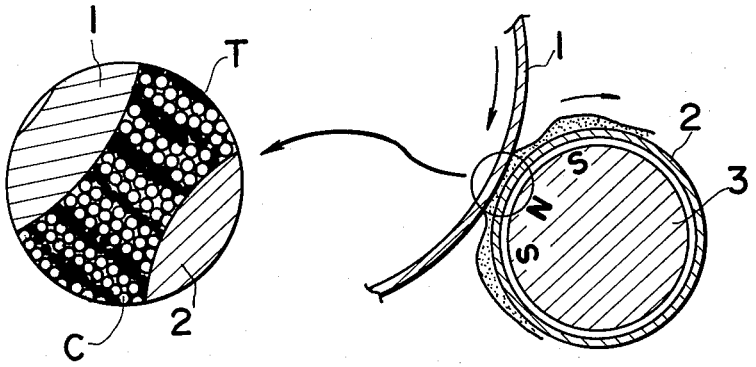
FIG. 1 is a diagram showing an apparatus employed for experiments on conventional iron carrier granules as used in reduced sizes and an exemplary mode of behavior of iron carrier granules and of toner particles observed in the experiments.

FIG. 1 schematically shows the apparatus used in Experiments 1 to 3 and including a member 1 rotatable in the direction of the arrow shown for bearing on its surface the electrostatic latent image to be developed. A developing sleeve 2 rotatable in the direction of the arrow shown covers a stationary magnet 3 which magnetically forms on the peripheral surface of the sleeve 2 a brush of a developer composed of toner particles T and carrier granules C. Accordingly the magnetic brush of the developer is adapted to develop the electrostatic latent image on the bearing member 1 by brushing contact therewith.

EXPERIMENT 1

The developer used was prepared from 10- to 20-μm toner particles and 40- to 60-μm carrier granules of iron (intrinsic resistivity: $9.8\times10^{-6}$ ohm-cm) in the weight ratio of 1:1 by mixing them together with stirring. The clearance between the latent image-bearing member 1 and the developing sleeve 2 was 3.5 mm.

The developed images obtained (which were observed after having been transferred onto copy paper from the image-bearing member 1 with use of a corona discharge unit, the same as in Experiments 2 and 3) had many white spots in the image areas and were unacceptable for use. However, as far as the toner images formed on the bearing member 1 were concerned, the images, although slightly fogged, were found superior in resolution and latitude to those obtained with use of conventional carrier granules about 100 to about 200 μm in diameter.

White spots were found to occur in the image areas with an increasing tendency with a decrease in the ratio of the toner particles relative to the carrier granules mixed therewith. This is attributable to the fact that with a smaller proportion of toner particles present, the carrier granules in the developer are more likely to contact one another, with the result that when the developer is formed into a brush, charges are injected into carrier granules from the developing sleeve, entailing deposition of the carrier granules on the latent image-bearing member. (The deposition of the carrier granules on the image-bearing member appears to resemble the deposition of a mono-component developer on the image-bearing member.) The carrier granules thus deposited in the image-bearing member hinder the transfer of toner particles to the copy paper in the vicinity of the deposited carrier granules during the transfer of the toner image to the copy paper by the action of corona charges. The hindrance of the toner transfer takes place presumably because the carrier granules, which are larger than the toner particles, interfere with the contact of the toner particles with the copy paper and result in a reduced transfer potential during the transfer in the vicinity of the deposited carrier granules.

EXPERIMENT 2

Another developing experiment was carried out under exactly the same conditions as in Experiment 1 except that the clearance between the image-bearing member 1 and the developing sleeve 2 was reduced to 1.0 mm.

The experiment resulted in more marked deposition of carrier granules on the latent-image bearing member and more pronounced occurrence of white spots in the image areas than in Experiment 1. A close observation of the developed images further revealed disturbances in high-potential portions of the electrostatic latent images. This appears to be attributable to the chain-like arrangement, shown in FIG. 1, of carrier granules C in direct contact with one another which is formed in the high-potential latent image areas and through which the charges thereof are released, thus breaking down the image areas. (The above-mentioned arrangement results from the magnetic attraction between carrier granules which acts to force out the intervening toner particles from therebetween since the carrier granules and toner particles are approximate in size.)

EXPERIMENT 3

Another developing experiment was carried out under exactly the same conditions as in Experiment 1 except that 25- to 35-μm iron carrier granules (intrinsic resistivity: $9.8\times10^{-6}$ ohm-cm) were used.

The experiment revealed still increased deposition of carrier granules on the latent-image bearing member and more marked chainlike arrangement of carrier granules as compared with the results achieved in Experiments 1 and 2. In fact, the developed images obtained were found to be in no way acceptable for use.

Experiments 1 to 3 thus indicate various difficulties experienced in the use of carrier granules of reduced sizes.

We have further conducted experiments and analyses and eventually found that electrostatic latent images can be developed with very satisfactory results with use of carrier granules having the properties of (1) triboelectrifying toner particles to a polarity suitable for developing the electrostatic latent image by coming into frictional contact with the toner particles, (2) being magnetic and (3) having a resistivity of at least $10^{12}$ ohm-cm, provided that the carrier granules are 5 to 40 μm, preferably 5 to 30 μm, more preferably 10 to 25 μm, in diameter. Thus this invention has been accomplished.

Such carrier granules can be prepared by dispersing magnetic fine particles in a resin having insulating properties and an intrinsic resistivity of at least $10^{14}$ ohm-cm. Examples of useful insulating resins are polyethylene, polyacrylic acid ester, polymethyl methacrylate, polystyrene, epoxy resin, cumarone resin, maleic acid resin, phenolic resin, fluorocarbon resin, etc. Exemplary of suitable magnetic fine particles are $Fe_2O_3$, $Fe_3O_4$, ferrite and like particles. The carrier granules of this invention can be prepared, for example, by mixing magnetic fine particles with the resin in a molten state, cooling the mixture, granulating the cooled mixture and screening the resulting granules.

Typical of the experiments conducted to accomplish this invention will be given later as Experiments 4 to 6.

Figure 2:
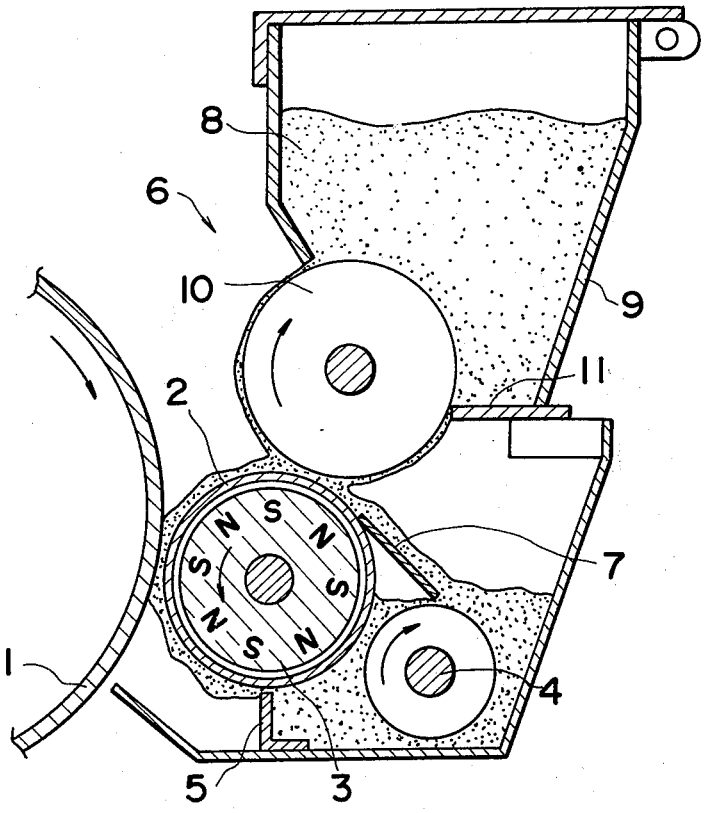
FIG. 2 is a diagram showing a developing apparatus for practicing the electrographic developing method of this invention.

FIG. 2 shows, for illustrative purposes, a developing apparatus for practicing the electrographic developing method of the invention. This apparatus, used for Experiments 4 to 6, has the following construction.

With reference to FIG. 2, the developing apparatus comprises a developing sleeve 2 of nonmagnetic material fixedly provided as opposed to a photosensitive member 1 serving as an electrostatic latent image-bearing member, and a magnetic roller 3 fitting in the sleeve 2 and rotatable at a high speed. Arranged close to the sleeve-and-roller assembly are a roller 4 for stirring a developer composed of toner particles and carrier granules, a blade 5 for regulating the height of a developer brush, a toner particle replenishing unit 6 and a scraping plate 7. The toner particle replenishing unit 6 includes a toner tank 9 for containing toner particles 8, a replenishing roller 10 with its periphery partially disposed within the toner tank 9 and formed with recesses in the peripheral surface thereof, and a plate 11 for regulating the amount of toner particles to be replenished. The sleeve 2 of the developing apparatus is spaced apart from the photosensitive member 1 by 0.7 mm.

EXPERIMENT 4

Carrier particles were prepared from the following main components:

HYMER-SBM-73 (styrene-acrylic resin; name used in trade and manufactured by Sanyo Chemical Industries, Ltd., Japan)

Iron Oxide RB-BL (name used in trade and manufactured by Chitan Kogyo Co., Ltd., Japan)

The resin and the magnetic material were mixed together in the ratio by weight of 1:1 to obtain 3- to 60-μm granules (resistivity: $10^{12}$ ohm-cm) as classified into the four groups of 3–5 μm, 5–20 μm, 20–40 μm and 40–60 μm in accordance with the diameter.

Toner particles (resistivity: at least $10^{14}$ ohm-cm, size: 10 μm) were prepared from the following main components:

PLIOLITE ACL (styrene-acrylic resin; name used in trade and manufactured by Good Year Chemical Co., U.S.A.)

Carbon black (manufactured by Mitsubishi Kasei Co., Ltd., Japan)

Nigrosine (manufactured by Orient Chemical Co., Ltd., Japan)

Four kinds of developers were prepared by mixing the toner particles with each group of the carrier granules and each used on the apparatus shown in FIG. 2 for experiment, with the results listed in Table 1 below.

With these developers, the combination of the carrier and toner indicates that the carrier granules will be triboelectrically charged negatively and the toner particles positively (the same as in Experiments 5 and 6 to follow). In these experiments, the electrostatic latent images have a negative polarity.

TABLE 1

| Size (μm) of carrier granules in developer | Developed image on photosensitive member | | | Transferred image |
|---|---|---|---|---|
| | Resolution | Fog | Latitude | |
| 40–60 | 7.1 | 0 | Δ | X |
| 20–40 | 8.0 | 0 | 0 | 0 |
| 5–20 | 7.1 | Δ | 0 | 0 |
| 3–5 | — | X | 0 | X |

The results given in Table 1 will be described in detail.

The results achieved with the developer containing 40- to 60-μm carrier granules:

The developed images on the photosensitive surface had a relatively good quality except that the latitude thereof was not fully satisfactory. However, carrier ganules were not infrequently found to have been deposited around the image areas. Such deposition of carrier granules produced many white spots in the transferred images, rendering the copy images very unslightly and unacceptable.

The results achieved with the developer containing 20- to 40-μm carrier granules:

The developed images on the photosensitive surface were satisfactory in every respect. Although a slightly larger amount of carrier granules were found around the image areas than in the case of the 40- to 60-μm granules, the transferred images were almost free from the above-mentioned white spots because the deposited carrier granules were smaller. (Especially the use of a developer containing 20- to 30-μm carrier granules or 20- to 25-μm carrier granules only produced no white spot whatever as ascertained by the unaided eye.) Additionally the transferred images were found to be in every way comparable to the developed images on the photosensitive surface and fully acceptable for use. It was also found that the transferred images were free of the transfer of the carrier deposit around the image areas.

The results achieved with the developer containing 5- to 20-μm carrier granules:

The developed images on the photosensitive surface had a fairly good quality, but deposition of a considerably increased amount of carrier granules around the image areas entailed fogging and a reduced resolution. However, except for some of the carrirer granules, the carrier deposit was not transferred to the copy paper, and the transferred images had a good quality and were fully useful. Selective use of 5- to 10-μm carrier granules in the developer, nevertheless, led to transfer of a fairly increased amount of carrier granules to the copy paper, consequently producing a noticeable fog in the transferred images.

The results achieved with the developer containing 3- to 5-μm carrier granules:

A large amount of carrier granules were found to have been deposited around the developed image areas on the photosensitive surface as well as on the copy paper. The copy images therefore had a very poor resolution and marked fog and were in no way acceptable.

The transferred image referred to in Table 1 was obtained by bringing the copy paper into intimate contact with the developed image-bearing photosensitive surface and simultaneously charging the paper on the rear surface thereof to a polarity opposite to the polarity of the charges on the toner particles by a corona discharge unit as is the case with Table 2 to follow. Since the method of transferring toner images by corona charging is already known and widely used for electrophotographic copying machines of the toner image transfer type, the method will not be described in detail.

EXPERIMENT 5

Several kinds of carrier granules, 10 to 25 μm in size and at least $10^9$ ohm-cm in resistivity, were prepared from the same main components as used for the carrier granules of Experiment 4. The resin and the magnetic material were mixed together also in the ratio by weight of 1:1. The carrier granules were classified into the four general groups of below $10^{10}$ ohm-cm, $10^{10}$–$10^{12}$ ohm-cm, $10^{12}$–$10^{14}$ ohm-cm and above $10^{14}$ ohm-cm in accordance with the resistivity. The same toner particles as used in Experiment 4 were mixed with each group of the carrier granules with stirring to prepare four kinds of developers, each of which was used on the apparatus shown in FIG. 2 for developing experiment. Table 2 below shows the results.

TABLE 2

| Resistivity (Ω · cm) of carrier granules in developer | Transferred image | Amount of carrier granules deposited on copy paper |
|---|---|---|
| Below $10^{10}$ | 0 | Large |
| $10^{10}$–$10^{12}$ | 0 | Large |
| $10^{12}$–$10^{14}$ | 0 | Small |
| Above $10^{14}$ | 0 | Very small |

The results given in Table 2 will be described in detail.

Since the transferred images were found to be similarly useful irrespective of the variations in the resistivity of carrier granules in the developer used, the description in this respect will not be given. The results achieved with use of the developers containing carrier granules below $10^{10}$ ohm-cm and $10^{10}$–$10^{12}$ ohm-cm in resistivity:

The carrier granules had a strong tendency to cling to the image areas on the photosensitive surface when developing, with a large quantity of carrier granules transferred therefrom to the image areas on the copy paper. The deposition of the large amount of carrier granules on the areas of paper where toner particles should be deposited impairs fixing of the transferred toner images, or imparts an unsightly color to the copy images because the images on the paper are then formed from toner particles and carrier granules of different colors. Furthermore the carrier granules transferred onto the copy paper are by no means recoverable; the deposition of carrier granules on copy paper in large quantities will lead to the waste of carrier granules.

To check the copy paper for the deposition of the carrier thereon, a magnet having a surface flux density of 1000 G was brought close to the rear surface of the paper. If the paper was attracted to the magnet, the result was interpreted as indicating the deposition of a large amount of carrier granules. The copy sheets obtained with the use of the developer of this experiment were of course readily attracted to the magnet. The results achieved with use of the developer containing carrier granules $10^{12}$–$10^{14}$ ohm-cm in resistivity:

A lesser degree of carrier deposition resulted on the copy paper approximately in the ratio of one carrier granule per 40 toner particles. When magnetically checked as above, the copy paper was barely attractable to the magnet. This degree of carrier deposition produced little or no influence on the fixing and color of the transferred images. Results achieved with use of the developer containing carrier granules above $10^{14}$ ohm-cm in resistivity:

The carrier granules deposited on the copy paper were barely observable under an electron microscope, hence a very small amount. The paper was not attractable to the magnet to any extent when checked as above.

EXPERIMENT 6

The same main components as used for the carrier granules of Experiment 4 were formulated into five kinds of carrier granules containing the magnetic component in the proportions of 30 wt. %, 40 wt. %, 50 wt. %, 60 wt. % and 70 wt. % respectively based on the whole carrier granules of each kind. The carrier granules were 10 to 25 μm in size and at least $10^{13}$ ohm-cm in resistivity. The same toner particles as used in Experiment 4 were mixed with each kind of the carrier granules with stirring to obtain five kinds of developers, each of which was used on the apparatus of FIG. 2 for developing experiment. The results are indicated in Table 3.

TABLE 3

| Proportion (wt. %) of magnetic component in carrier | Deposition of carrier granules on photosensitive surface | | Conveyability of developer |
|---|---|---|---|
| | Around image areas | Image areas | |
| 30 | X | X | X |
| 40 | X | Δ | X |
| 50 | Δ | Δ | 0 |
| 60 | 0 | 0 | 0 |
| 70 | 0 | 0 | 0 |

The results listed in Table 3 will be described below in detail.

In preparing carrier granules by dispersing a finely divided magnetic material in a resin, it is substantially impossible to use 75 wt. % or more of the magnetic material, so that carrier granules containing more than 70 wt. % of the magnetic material were not tested in the present invention.

Deposition of carrier granules on the photosensitive surface (around image areas):

Deposition of carrier granules took place in the case of carrier granules containing 50 wt. % of the magnetic material, and that noticeably with the carrier granules containing 40 wt. % or less of the magnetic material. Unless in a large amount, however, the deposition of carrier will not be transferred to the copy paper. In fact, no particular adverse effects were found on the transferred images with use of the developers of this experiment.

Deposition of carrier granules on the photosensitive surface (image areas):

Deposition of carrier granules took place with the carrier granules containing 50 wt. % of the magnetic material, and that noticeably with those containing 30 wt. % or less of the magnetic material. Deposition of carrier granules is undesirable as described in Experiment 5. As a matter of fact, appreciable objections occured if the proportion of the magnetic material was not more than 30 wt. %.

Conveyability of the developer:

When repeatedly used for developing experiment, the developers containing carrier granules not more than 40 wt. % in the proportion of the magnetic material lodged in various portions of the developing apparatus due to the poor flowability of the developer, with the result that the developing station was not fully given the developer. Thus such developers are seriously defective in conveyability. The developers in which the carrier granules contained at least 50 wt. % of the magnetic material were found usable continuously over a prolonged period of time free of the above-mentioned trouble.

Described below is a preferred example of the electrographic developing method of the present invention. According to this example, the method was practiced using a developing apparatus such as one shown in FIG. 2 and a developer composed of toner particles and carrier granules both prepared from the same main components as used in Experiment 4, the carrier granules being $10^{13}$ ohm-cm in resistivity, 15 μm in average size and 60 wt. % in the proportion of the magnetic material. The clearance between the photosensitive member 1 and the developing sleeve 2 was set at 0.5 mm, and the developing sleeve 2 was given a bias voltage of the same polarity as the electrostatic latent image on the photosensitive member.

An electrostatic latent image on the photosensitive member 1 (highest potential of the image areas: −750 V, potential of the nonimage areas: −150 V) was developed using the developer with its carrier to toner ratio adjusted to 9:1 by weight and applying a bias voltage of −150 V, whereby a positive toner image was formed on the photosensitive surface with a high degree of resolution and high quality. The toner image was then transferred onto copy paper by corona charging and thereafter fixed by a known fixing unit. As a result, a fixed toner image of high resolution and high quality was formed on the paper free from any fog.

The clearance between the photosensitive member 1 and the developing sleeve 2 and the value of the bias voltage to be applied to the developing sleeve 2 must be determined suitably in accordance with the conditions of the electrostatic latent image to be developed even when the same developer is used. For example, it was found suitable to set the clearance at 0.7 mm and the bias voltage at −400 V for an electrostatic latent image which was −600 V in the highest potential of its image areas and −350 V in the potential of the nonimage areas thereof.

Under the foregoing conditions, the developer was used repeatedly over a prolonged period of time. When thereafter checked, the surfaces of carrier granules in the developer were found free of any fusion of the toner, At the same time, images obtained with the developer after having been used thus repeatedly were checked for quality. The results indicated that the toner images were available at any time with the same stable quality as those produced at the beginning of the developing operation. This was confirmed when an electrostatic latent image of A4 size was developed 60,000 times.

The developer was further checked for the permissible range of toner to carrier ratios that would give acceptable toner images by using the developer under the same conditions as above except that the mixing ratio was altered variously. As the result, the permissible range was found to be as wide as 2 to 50 wt. %, preferably 6 to 35 wt. %, in terms of the proportion of the toner particles. For reference, the corresponding permissible range of toner proportions is as narrow as 0.8 to 1.8 wt. % in the case where the toner is used with carrier beads of about 150 to about 250 μm in average size, or 4 to 8 wt. % relative to iron carrier granules of about 100 μm in average size.

Although the developing sleeve 2 is stationary in the developing apparatus shown in FIG. 2 for practicing the developing method of this invention, it is desirable for imparting improved stirability to the developer to render the sleeve 2 rotatable in the same direction as the magnetic roller 3 at a low speed. With the present developing method, it is further desirable that the carrier granules remaining on the photosensitive surface after the transfer be recovered as by a blade cleaner for the reuse of the carrier granules for development.

Although the present invention has been fully described by way of examples with reference to the accompanying drawings, it is to be noted that various changes and modifications are apparent to those skilled in the art. Therefore, unless otherwise such changes and modifications depart from the scope of the present invention, they should be construed as included therein.

We claim:

1. An electrographic developing method for developing electrostatic latent images which comprises the steps of:

(1) mixing insulating non-magnetic toner particles and carrier granules consisting essentially of an electrical insulating resin and at least 50%, by weight of the carrier granules, of magnetizable fine particles where the carrier granules have the properties of (1) triboelectrically charging the toner particles to a polarity suitable for developing the latent image by frictional contact with the toner particles, (2) being magnetic, (3) having an electro-resistivity of at least $10^{12}$ ohm-cm, and (4) being all substantially within the size range of 5 to 40 μm; said toner particles being present in an amount of 2–50% by weight of the toner-carrier mixture;

(2) magnetically attracting said mixture onto a developing sleeve which opposes a recording medium with narrow clearance at the developing station of 1.0 mm and under; and (3) flowing said mixture around the developing sleeve and to the developing station for applying said mixture on an electrostatic latent image formed on the recording medium and for developing said electrostatic latent image into a visible image.

2. An electrographic developing method as claimed in claim 1, wherein said carrier granules are 5 to 30 μm in size.

3. An electrographic developing method as claimed in claim 1, wherein said carrier granules are 10 to 25 μm in size.

4. An electrographic developing method as claimed in claim 1, wherein said carrier granules have an electro-resistivity of at least $10^{14}$ ohm-cm.

5. An electrographic developing method as claimed in claim 1, wherein said carrier granules contain the magnetizable fine particles in the proportion of 50 to 75wt% based on the whole carrier granules.

6. An electrographic developing method as claimed in claim 5, further comprises a step of:

transferring said visible image onto copy paper from the recording medium with use of a corona discharge unit.

7. An electrographic developing method as claimed in claim 6, further comprises a step of:

recovering the carrier granules remaining on the recording medium after the transfer for the reuse of the carrier granules for development.

8. An electrographic developing method as claimed in claim 1, wherein said clearance is 0.5 to 1.0 mm.

9. An electrographic developing method as claimed in claim 1, wherein said step (3) is accomplished by rotating a multi-pole magnetic roller within the developing sleeve, while holding said developing sleeve stationary.

10. An electrographic developing method as claimed in claim 1, wherein the carrier granules are triboelectrically charged to a polarity opposite that of the toner particles.

11. An electrographic developing method as claimed in claim 1, wherein there is mounted on the developing sleeve a rotatable magnetic roller which is rotated during the development of the electrostatic image.

12. An electrographic developing method as claimed in claim 11, wherein during the developing operation, the magnetic roller is rotated and the recording medium is swept by a magnetic brush formed of said mixtures of toner particles and carrier to develop the electrostatic latent image.

13. An electrographic developing method is claimed in claim 1, wherein the developing sleeve is rotatable.

* * * * *

UNITED STATES PATENT AND TRADEMARK OFFICE

CERTIFICATE OF CORRECTION

PATENT NO. : 4,284,702

DATED : August 18, 1981

INVENTOR(S) : Kenji TABUCHI; Susumu TANAKA; Kenichi WADA; Tateki OKA; and Hiroaki MIZUNOE It is certified that error appears in the above-identified patent and that said Letters Patent are hereby corrected as shown below:

First Page, Column 1, under the Title, between the information designated Paragraphs "[22]" and "[63]", please insert the following:

-- [30] Foreign Application Data

| | | |
|---|---|---|
| Nov. 5, 1977 | Japan | 52-132680 |
| Aug. 28, 1978 | Japan | 53-105,214 -- |

Signed and Sealed this

Thirtieth Day of March 1982

[SEAL]

Attest:

GERALD J. MOSSINGHOFF

Attesting Officer

Commissioner of Patents and Trademarks